US011166548B2

(12) United States Patent
Whiteway

(10) Patent No.: US 11,166,548 B2
(45) Date of Patent: Nov. 9, 2021

(54) MULTI-USE DESK-CABINET

(71) Applicant: Larry Whiteway, Lower Sackville (CA)

(72) Inventor: Larry Whiteway, Lower Sackville (CA)

( * ) Notice: Subject to any disclaimer, the term of this patent is extended or adjusted under 35 U.S.C. 154(b) by 0 days.

(21) Appl. No.: 17/029,270

(22) Filed: Sep. 23, 2020

(65) Prior Publication Data

US 2021/0085078 A1 Mar. 25, 2021

(30) Foreign Application Priority Data

Sep. 24, 2019 (CA) ..... CA 3056566

(51) Int. Cl.

| | |
|---|---|
| ***A47B 83/04*** | (2006.01) |
| ***A47B 97/00*** | (2006.01) |
| ***A47B 23/04*** | (2006.01) |
| ***A47B 5/00*** | (2006.01) |
| ***A47B 46/00*** | (2006.01) |

(52) U.S. Cl.

CPC ..... *A47B 83/045* (2013.01); *A47B 5/006* (2013.01); *A47B 23/04* (2013.01); *A47B 46/00* (2013.01); *A47B 97/001* (2013.01)

(58) Field of Classification Search

CPC ..... A47B 5/00; A47B 5/006; A47B 13/081; A47B 21/00; A47B 21/03; A47B 21/0314; A47B 23/04; A47B 46/00; A47B 46/005; A47B 83/045; A47B 2200/0068; A47B 2200/01; A47B 2021/0307

See application file for complete search history.

(56) References Cited

U.S. PATENT DOCUMENTS

| | | | | | |
|---|---|---|---|---|---|
| 1,883,504 | A * | 10/1932 | Bolles | A47B 83/045 312/279 |
| 1,933,144 | A * | 10/1933 | Karp | A47B 83/045 312/289 |
| 2,112,087 | A * | 3/1938 | Golod | A47B 83/045 312/204 |
| 2007/0114894 | A1* | 5/2007 | Milburn | A47B 46/005 312/245 |
| 2011/0279951 | A1* | 11/2011 | Kinsley | A47B 46/005 361/679.01 |
| 2016/0143431 | A1* | 5/2016 | Lee | A47B 17/03 312/324 |

FOREIGN PATENT DOCUMENTS

| | | | | |
|---|---|---|---|---|
| DE | 2154352 | A1 * | 5/1973 | A47B 5/00 |
| FR | 624569 | A * | 7/1927 | A47B 83/045 |
| FR | 1258100 | A * | 4/1961 | A47B 83/045 |
| FR | 2629855 | A1 * | 10/1989 | A47B 5/006 |
| GB | 2217186 | A * | 10/1989 | B25H 3/00 |

* cited by examiner

*Primary Examiner* — Andrew M Roersma
(74) *Attorney, Agent, or Firm* — Bonini IP Law, LLC; Frank J. Bonini, Jr.

(57) ABSTRACT

A multi-use desk-cabinet is provided. The multi-use desk-cabinet comprises a rear cabinet wall having a left and a right side cabinet wall mounted thereto. A desk plate is slidably and pivotally movable mounted to each of the left and the right side cabinet wall such that the desk plate is movable from a substantially vertical position in proximity to a front end of the left and the right side cabinet wall to a substantially horizontal position such that a rear end of the desk plate is placed in close proximity to the rear cabinet wall.

6 Claims, 5 Drawing Sheets

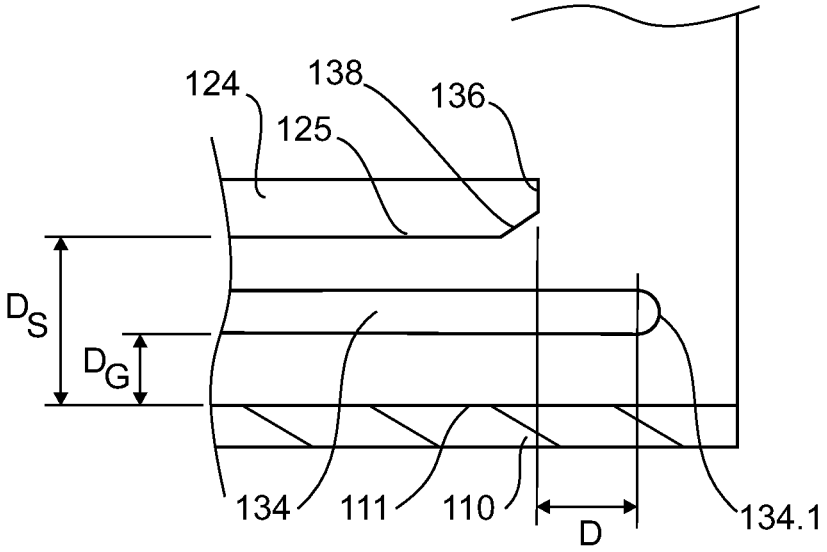
Figure 6 (DETAIL A)
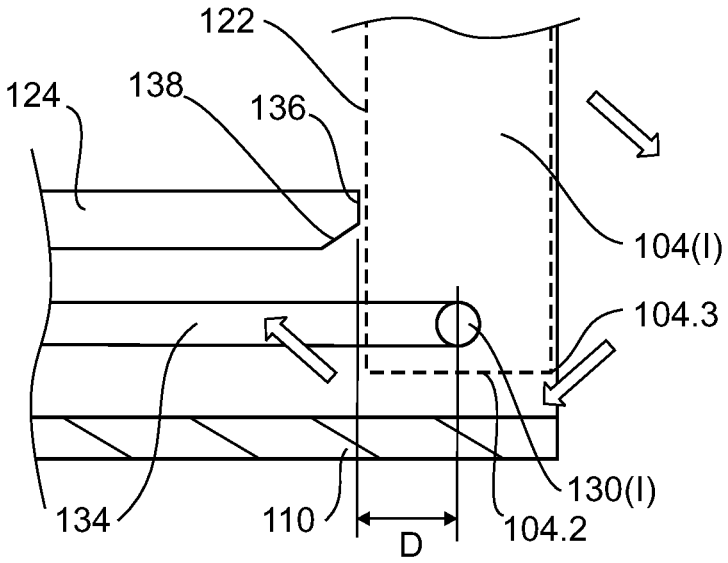
Figure 7 (DETAIL A)

MULTI-USE DESK-CABINET

BACKGROUND OF THE INVENTION

1. Field of the Invention

The present invention relates to a piece of furniture, and more particularly to a space saving multi-use desk-cabinet.

2. Brief Description of the Related Art

In many urban and suburban areas, living space is a premium. Limited floor space in apartments, homes, and other living spaces can make it difficult to properly furnish a space for one or more desired purposes. The limited floor space makes it difficult to provide sufficient space for storing items such as, for example, children's toys, books, etc., as well as sufficient desk space for playing or doing homework. The same problem arises for various other home activities requiring space for storing items as well as for working such as, for example, a computer space, reading/learning space, home office space, and art and crafts space.

There are various pieces of furniture available for use in situations of limited floor space such as, for example, wall desks and secretary desks. Unfortunately, they either provide very limited or no storage space or very limited desk size.

It is desirable to provide a multi-use desk-cabinet that provides sufficient storage space, as well as sufficient desk space.

It is also desirable to provide a multi-use desk-cabinet with a desk plate that is pivotally and slidably movable from a substantially vertical position to a horizontal position.

It is also desirable to provide a multi-use desk-cabinet wherein a substantial portion of the desk plate is placed inside the cabinet when the desk plate is in the horizontal position.

It is also desirable to provide a multi-use desk-cabinet wherein the desk plate is adapted for use as a white board when the desk plate is in the vertical position.

SUMMARY OF THE INVENTION

Accordingly, one object of the present invention is to provide a multi-use desk-cabinet that provides sufficient storage space, as well as sufficient desk space.

Another object of the present invention is to provide a multi-use desk-cabinet with a desk plate that is pivotally and slidably movable from a substantially vertical position to a horizontal position.

Another object of the present invention is to provide a multi-use desk-cabinet wherein a substantial portion of the desk plate is placed inside the cabinet when the desk plate is in the horizontal position.

Another object of the present invention is to provide a multi-use desk-cabinet wherein the desk plate is adapted for use as a white board when the desk plate is in the vertical position.

According to one aspect of the present invention, there is provided a multi-use desk-cabinet. The multi-use desk-cabinet comprises a rear cabinet wall having a left and a right side cabinet wall mounted thereto. A desk plate is slidably and pivotally movable mounted to each of the left and the right side cabinet wall such that the desk plate is movable from a substantially vertical position in proximity to a front end of the left and the right side cabinet wall to a substantially horizontal position such that a rear end of the desk plate is placed in close proximity to the rear cabinet wall.

According to the aspect of the present invention, there is provided a multi-use desk-cabinet. The multi-use desk-cabinet comprises a rear cabinet wall having a left and a right side cabinet wall mounted thereto. A desk plate is slidably and pivotally movable mounted to each of the left and the right side cabinet wall such that the desk plate is movable from a substantially vertical position in proximity to a front end of the left and the right side cabinet wall to a substantially horizontal position such that a rear end of the desk plate is placed in close proximity to the rear cabinet wall. A left and right side guiding groove is disposed in each of the left and the right side cabinet wall, respectively and a left and right side guiding pin are mounted to a rear portion of the desk plate. Each of the left and right side guiding pin is slidably and pivotally movable accommodated in the respective left and right side guiding groove.

According to the aspect of the present invention, there is provided a multi-use desk-cabinet. The multi-use desk-cabinet comprises a rear cabinet wall having a left and a right side cabinet wall mounted thereto. A desk plate is slidably and pivotally movable mounted to each of the left and the right side cabinet wall such that the desk plate is movable from a substantially vertical position in proximity to a front end of the left and the right side cabinet wall to a substantially horizontal position such that a rear end of the desk plate is placed in close proximity to the rear cabinet wall. The multi-use desk-cabinet further comprises a desk enclosure top wall and a desk enclosure bottom wall. The desk enclosure top wall and the desk enclosure bottom wall are mounted to the rear cabinet wall and the left and the right side cabinet wall such that the same form a desk enclosure in concert with the desk plate when placed in the substantially vertical position.

The advantage of the present invention is that it provides a multi-use desk-cabinet that provides sufficient storage space, as well as sufficient desk space.

A further advantage of the present invention is that it provides a multi-use desk-cabinet with a desk plate that is pivotally and slidably movable from a substantially vertical position to a horizontal position.

A further advantage of the present invention is that it provides a multi-use desk-cabinet wherein a substantial portion of the desk plate is placed inside the cabinet when the desk plate is in the horizontal position.

A further advantage of the present invention is that it provides a multi-use desk-cabinet wherein the desk plate is adapted for use as a white board when the desk plate is in the vertical position.

BRIEF DESCRIPTION OF THE DRAWINGS

A preferred embodiment of the present invention is described below with reference to the accompanying drawings, in which.

DESCRIPTION OF THE PREFERRED EMBODIMENT

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

Figure 1:
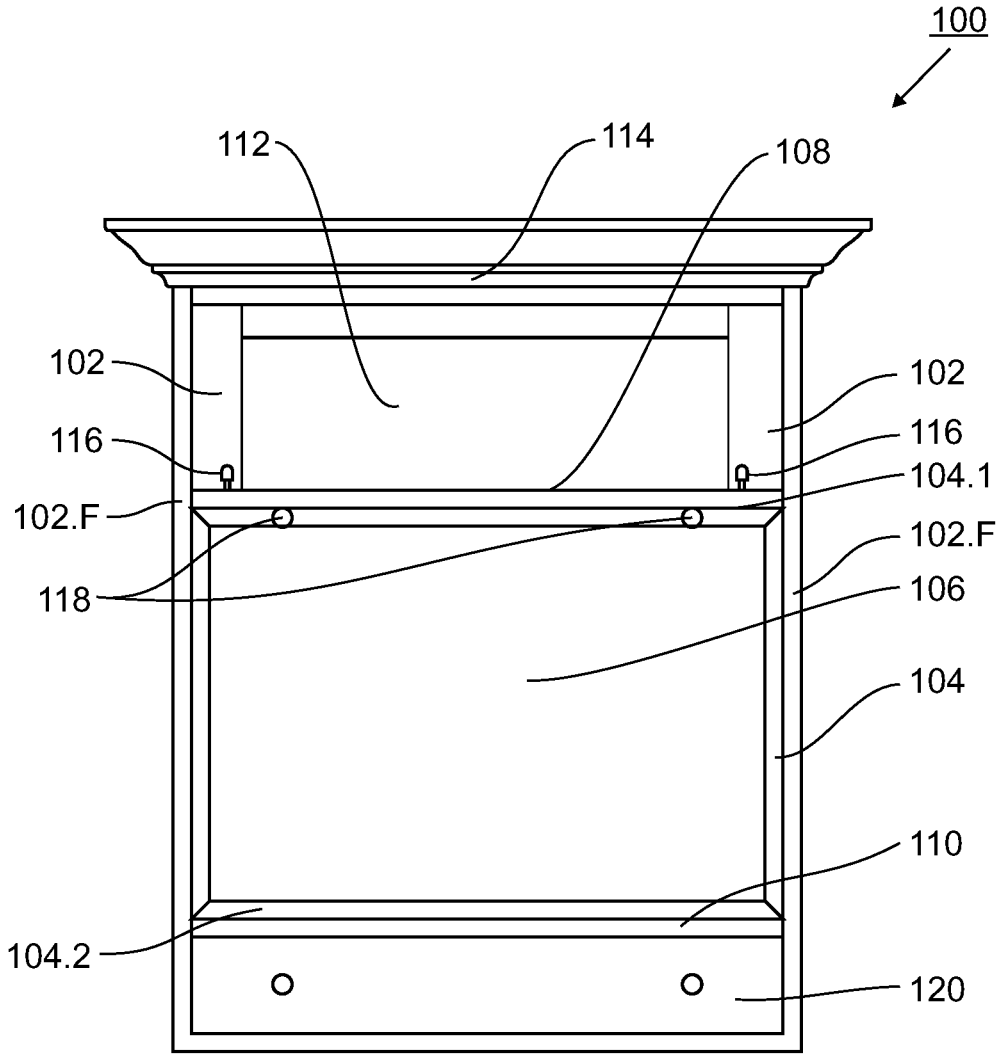
FIGS. 1 and 2 are simplified block diagrams illustrating in front perspective views a multi-use desk-cabinet according to the preferred embodiment of the invention with the desk plate being in the vertical position and in the horizontal position, respectively.
Figure 2:
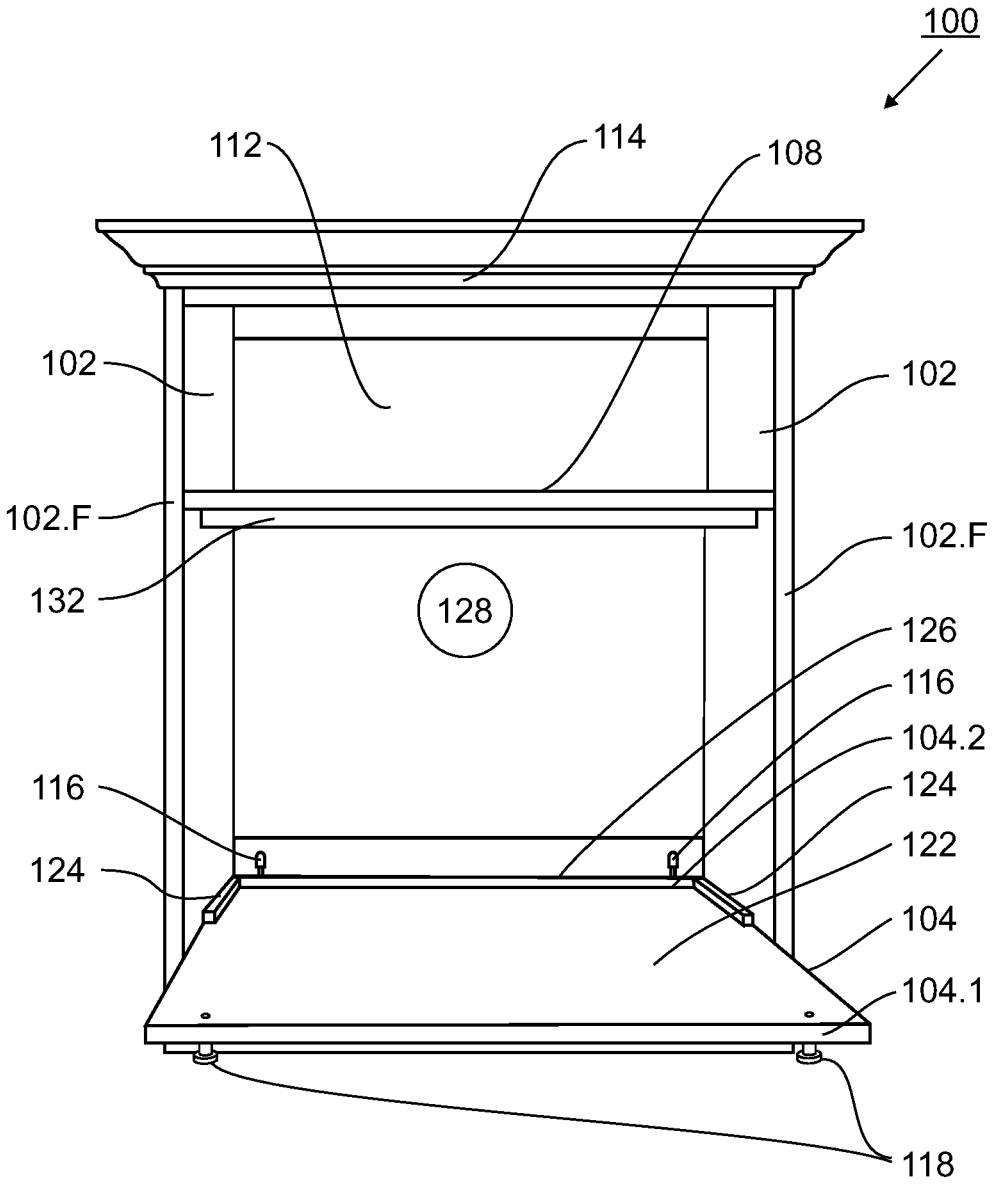
Figure 3:
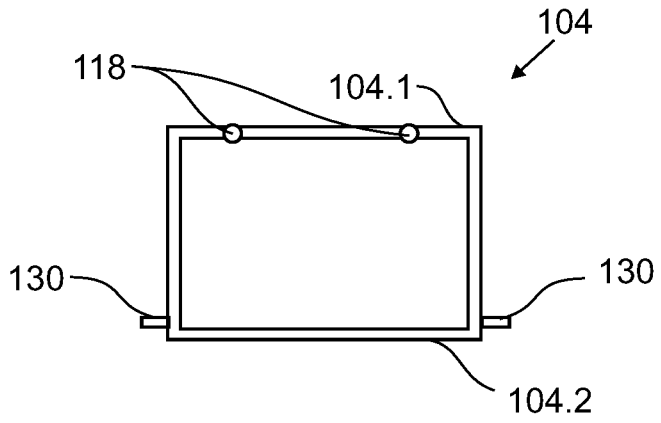
FIG. 3 is a simplified block diagram illustrating in a bottom view the desk plate of the multi-use desk-cabinet according to the preferred embodiment of the invention.
Figure 4:
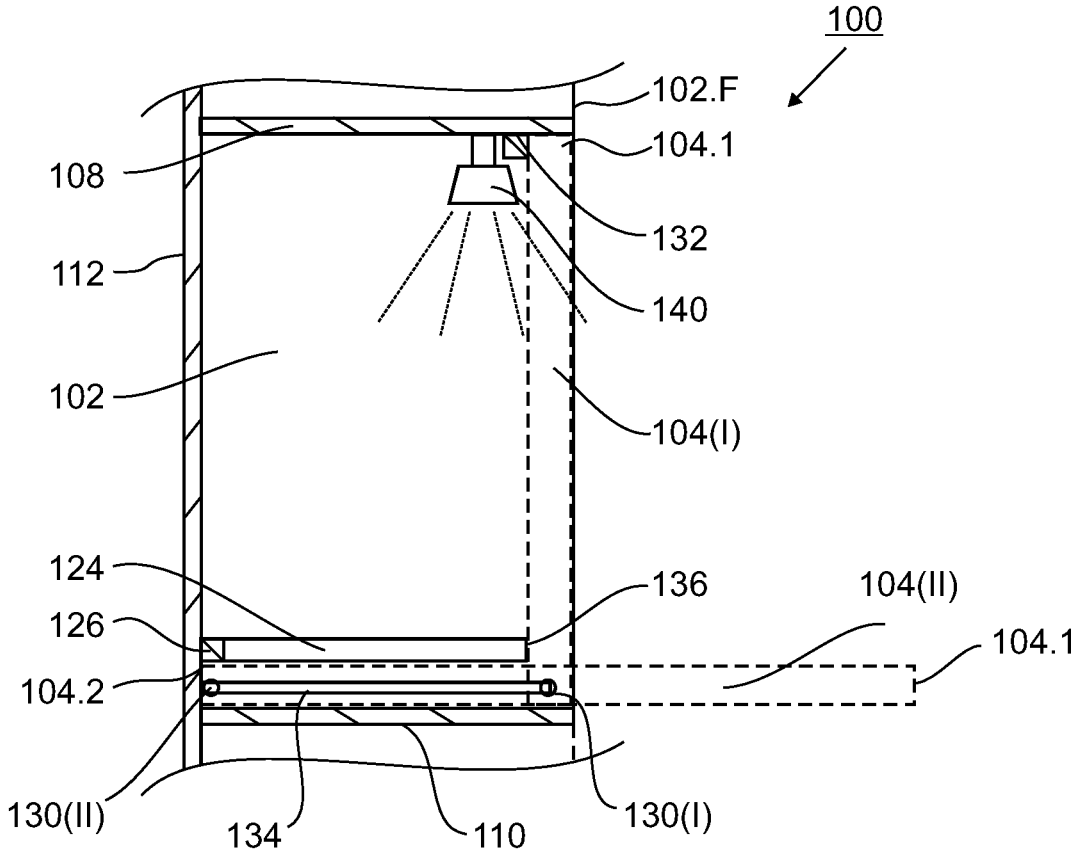
FIG. 4 is a simplified block diagram illustrating in a cross sectional view the multi-use desk-cabinet according to the preferred embodiment of the invention.

Referring to FIGS. 1 to 7 a multi-use desk cabinet 100 according to a preferred embodiment of the invention is provided. The multi-use desk cabinet 100 comprises rear cabinet wall 112 having left and right side cabinet walls 102 mounted thereto. Desk plate 104 is slidably and pivotally movable mounted to each of the left and the right side cabinet wall 102 such that the desk plate 104 is movable from a substantially vertical position in proximity to a front end 102.F of the left and the right side cabinet wall 102, as illustrated in FIGS. 1 and 4, to a substantially horizontal position such that a rear end 104.2 of the desk plate 104 is placed in close proximity to the rear cabinet wall 112, as illustrated in FIGS. 2 and 4. The multi-use desk-cabinet 100 further comprises desk enclosure top wall 108 and desk enclosure bottom wall 110. The desk enclosure top wall 108 and the desk enclosure bottom wall 110 are mounted to the rear cabinet wall 112 and the left and the right side cabinet wall 102 such that the same form a closed desk enclosure 128 in concert with the desk plate 104 when the same is placed in the substantially vertical position (I).

Figure 5:
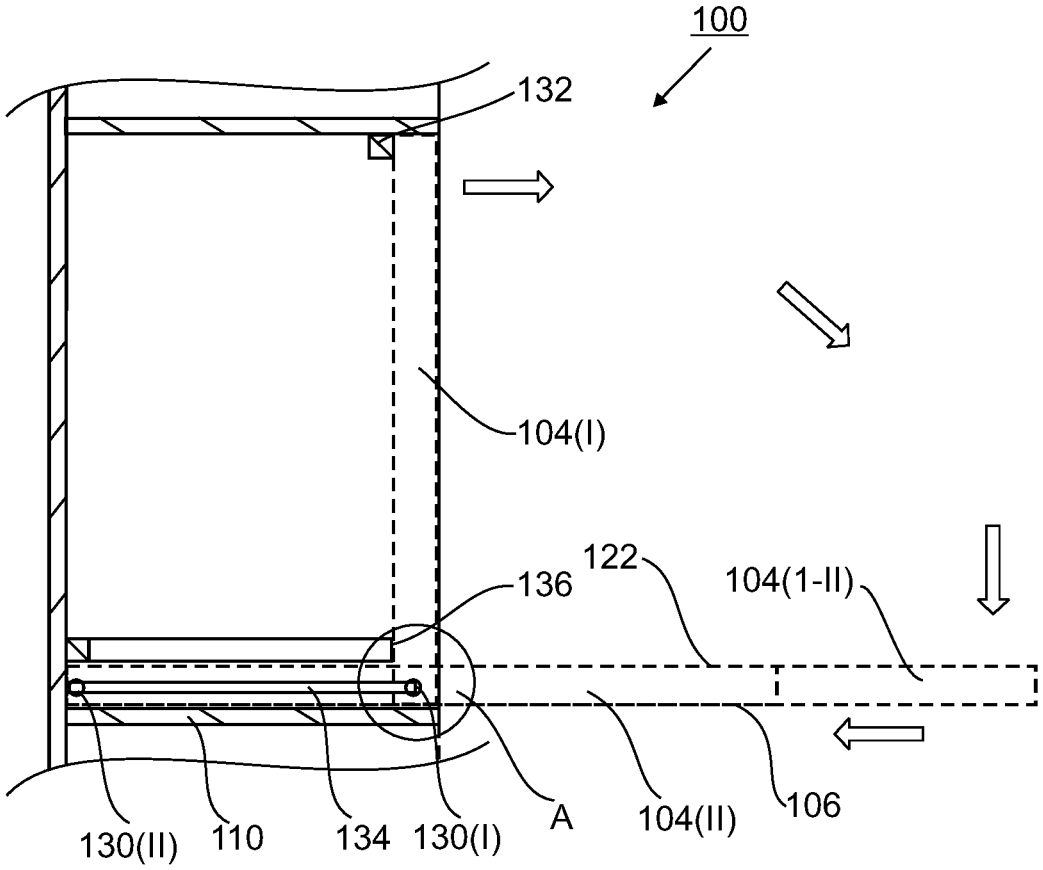
FIG. 5 is a simplified block diagram illustrating in a cross sectional view the movement of the desk plate of the multi-use desk-cabinet according to the preferred embodiment of the invention; and, FIGS. 6 and 7 are simplified block diagrams illustrating in cross sectional views a detail of the multi-use desk-cabinet according to the preferred embodiment of the invention without and with the desk plate, respectively.

Movement of the desk plate 104 from the vertical position (I) to the horizontal position (II) is enabled by providing left and right side guiding pins 130 mounted to a rear portion in proximity to the rear end 104.2 of the desk plate 104, as illustrated in FIG. 3, and left and right side guiding grooves 134 disposed in each of the left and the right side cabinet wall 102, respectively. Each of the left and right side guiding pins 130 is slidably and pivotally movable accommodated in the respective left and right side guiding groove 134, as illustrated in FIG. 4. As illustrated in FIG. 5, the desk plate 104 is moved from the vertical position (I) into the horizontal position (II) by:

first rotating the desk plate 104 (I) about the guiding pins when in the vertical position 130 (I), as indicated by the block arrows until an intermediate horizontal position of the desk plate 104 (I-II) is reached; and, second by horizontally moving the desk plate 104 (I-II) towards the rear cabinet wall 112 to desk plate position 104 (II) with the guiding pins 130 being slidably moved inside the guiding grooves 134 from the position 130 (I) to the position 130 (II) while holding the desk plate 104 (I-II) substantially horizontal, as indicated by the block arrow. Alternatively, the guiding grooves 134 may be replaced by guiding rails mounted to the left and the right side cabinet wall 102.

For closing the multi-use desk cabinet 100, the same steps are performed in reverse.

Preferably, when in the vertical position (I) the desk plate 104 is abutted in proximity to a front end 104.1 thereof by upper stopping element 132 mounted to the desk enclosure top wall 108 and in proximity to the rear end 104.2 thereof by front end 136 of left and right side slide rails 124, which are mounted to the left and right side cabinet walls 102 a predetermined distance above the left and right side guiding grooves 134, respectively. Alternatively, the upper stopping element 132 is replaced by stopping elements mounted to the side cabinet walls 102 or by a front end of the desk enclosure top wall 108 which may be recessed with respect to the front ends 102.F of the side cabinet walls 102. Further preferably, distance D between the front ends 136 of the left and right side slide rails 124 and front end 134.1 of the left and right side guiding grooves 134 is determined such that top surface 122 of the desk plate 104 when in the vertical position (I) is in close proximity to the front end 134.1 of the left and right side guiding grooves 134 while the guiding pins 130 are in close proximity to the front end 134.1 of the left and right side guiding grooves 134, as illustrated in FIGS. 6 and 7.

Preferably, the left and right side slide rails 134 are placed a predetermined Distance $D_S$ above a top surface of the desk enclosure bottom wall 110 and the left and right side guiding grooves 134 are placed a predetermined Distance $D_G$ above the top surface of the desk enclosure bottom wall 110 such that the desk plate 104 is slidably movable between the top surface 111 of the desk enclosure bottom wall 110 and a bottom surface 125 of the left and right side slide rails 124 with the top surface 122 and a bottom surface 106 of the desk plate 104 being in close proximity to the bottom surface 125 of the left and right side slide rails 134 and the top surface 111 of the desk enclosure bottom wall 110, respectively. A rear portion of the desk plate 104 is then abutted in the horizontal position (II) by the guiding pins 130 accommodated in the respective guiding grooves 134 and/or by a rear portion of the top surface 122 touching the bottom surface 125 of the left and right side slide rails 124, while a mid portion of the bottom surface 106 touching the top surface 111 of the desk enclosure bottom wall 110. Furthermore, placement of the guiding pins 130 with respect to the rear end 104.2 of the desk plate, the distances $D_S$ and $D_G$, and bevel 138 of the left and right side slide rails 124 are determined such that the desk plate 104 is rotatable when the guiding pins are in position 130 (I), as illustrated in FIG. 7. Optionally, stay 126 is mounted to the rear cabinet wall 112 for abutting a rear portion of the top surface 122 of the desk plate 104 when in the horizontal position (II). Further optionally, edge 104.3 is beveled to facilitate the rotation of the desk plate 104 about the guiding pin in position 130 (I). Further optionally, the slide rails 124 are omitted and the desk plate 104 is abutted in the vertical position (I) in proximity to the rear end 104.2 thereof by stopping elements mounted to the side cabinet walls 102.

The desk plate 104 is secured in the vertical position (I) using, for example, tapered metal pins 116 accommodated in respective bores disposed in the desk enclosure top wall 108 and the front end 104.1 of the desk plate 104, as illustrated in FIG. 1. Alternatively, a door magnet or a lock may be employed. Optionally, the metal pins 116 may also be used for securing the desk plate 104 in the horizontal position (II) by accommodating them in respective bores disposed in the stay 126 and a rear portion of the desk plate 104. Handling of the desk plate 104 is facilitated using, for example, knobs 118 mounted to the bottom surface 106 of the desk plate 104 in proximity to the front end 104.1.

Optionally, at least a portion of the bottom surface 106 of the desk plate 104 is adapted to form a whiteboard.

Optionally, one or more light fixtures 140 are disposed inside the desk enclosure 128, for example, mounted to desk enclosure top wall 108, as illustrated in FIG. 4.

Further optionally, one or more shelves are disposed inside the desk enclosure 128 and, for example, height adjustable mounted to the left and right side cabinet walls 102.

Further optionally, electrical outlets are disposed inside the desk enclosure 128, for example, mounted to the rear cabinet wall 112.

Further optionally, drawer 120 is disposed below the desk enclosure bottom wall 110 using, for example, commercially available ball bearing slides.

Further optionally, additional storage space may be provided above the desk enclosure top wall 108 by extending the left and right side cabinet walls 102 and the rear cabinet wall 112 upwardly and by providing top wall 114.

The multi-use desk cabinet 100 may be provided as a unit for being mounted to a wall or as a free-standing unit by extending the left and right side cabinet walls 102 downwardly to a floor. Optionally, a conventional mechanism for adjusting the height of the multi-use desk cabinet 100 above the floor may be provided.

In an example implementation of the multi-use desk cabinet 100 the walls, shelves, and the desk plate 104 have been made of ¾" melamine panels and assembled using screw fasteners and/or adhesive. The guiding pins 130 are steel pins mounted to the desk plate 104 in a screw type fashion. The slide rails 124 and the stay 126 are made of oak and mounted to the respective walls using screw fasteners and/or adhesive. The multi-use desk cabinet 100 is approximately 38" wide, 48" high (with storage extension above the desk enclosure top wall), and 12" deep. The desk plate is approximately 36" wide and 25" deep. As is evident to those skilled in the art, the multi-use desk cabinet 100 is not limited thereto, but may be adapted for various uses in different sizes and made of different materials.

It is noted that while reference has been made to the rear cabinet wall 112 throughout this disclosure for simplicity, the multi-use desk cabinet 100 is not limited thereto. Since the rear of the multi-use desk cabinet 100 is likely placed against a wall, it is understood that the expression 'rear cabinet wall 112' may refer to any structure for securing the angular relationship between the vertically oriented side cabinet walls 102 and the horizontally oriented desk enclosure top and bottom walls 108, 110.

The present invention has been described herein with regard to preferred embodiments. However, it will be obvious to persons skilled in the art that a number of variations and modifications can be made without departing from the scope of the invention as described herein.

What is claimed is:

1. A multi-use desk-cabinet comprising:

a rear cabinet wall having a left and a right side cabinet wall mounted thereto;

a desk plate slidably and pivotally movable mounted to each of the left and the right side cabinet wall such that the desk plate is movable from a substantially vertical position in proximity to a front end of each of the left and the right side cabinet wall to a substantially horizontal position such that a rear end of the desk plate is placed in close proximity to the rear cabinet wall;

a left and a right side guiding groove disposed in the left and the right side cabinet wall, respectively;

a left and a right side guiding pin mounted to a rear portion of the desk plate, the left and the right side guiding pins being slidably and pivotally movable accommodated in the left and right side guiding grooves;

a left and a right side slide rail mounted to the left and the right side cabinet wall a predetermined distance above the left and the right side guiding groove, respectively, a front end of the left and the right side slide rail being adapted for abutting the rear portion of the desk plate when placed in the substantially vertical position;

means for abutting the desk plate when placed in the substantially vertical position comprising an upper stopping element for abutting a front portion of the desk plate; and, means for abutting the desk plate when placed in the substantially horizontal position comprising a lower stopping element for abutting a mid portion of the desk plate.

2. The desk-cabinet according to claim 1, wherein the desk plate is adapted to form a whiteboard when placed in the substantially vertical position.

3. The desk-cabinet according to claim 1, comprising a desk enclosure top wall and a desk enclosure bottom wall, the desk enclosure top wall and the desk enclosure bottom wall being mounted to the rear cabinet wall and the left and the right side cabinet wall to thereby form a desk enclosure in concert with the desk plate when placed in the substantially vertical position.

4. The desk-cabinet according to claim 3, comprising at least a shelf disposed inside the desk enclosure.

5. The desk-cabinet according to claim 4, comprising at least a light fixture mounted to an inside surface of the desk enclosure.

6. The desk-cabinet according to claim 3, comprising a drawer mounted to the left and the right side cabinet wall below the desk enclosure bottom wall.

* * * * *